US006532990B1

(12) United States Patent
Wood et al.

(10) Patent No.: US 6,532,990 B1
(45) Date of Patent: Mar. 18, 2003

(54) AIR COMPRESSOR ASSEMBLY INCLUDING A LIFTING HANDLE

(75) Inventors: Mark W. Wood, Jackson, TN (US); Robert F. Burkholder, Jackson, TN (US); Crandall B. Barbour, Jackson, TN (US); Mike L. Davis, Jackson, TN (US); Fred M. Morgan, Jackson, TN (US); David W. Robenalt, Jackson, TN (US); Dave C. Smith, Jackson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/801,406

(22) Filed: Mar. 8, 2001

Related U.S. Application Data

(60) Provisional application No. 60/187,680, filed on Mar. 8, 2000.

(51) Int. Cl.[7] ..... B60P 3/22
(52) U.S. Cl. ..... 137/899.4; 137/269; 137/271
(58) Field of Search ..... 137/269, 271, 137/899.4

(56) References Cited

U.S. PATENT DOCUMENTS 2,122,656 A * 7/1938 Paget ..... 137/899.4
2,826,354 A * 3/1958 Field ..... 137/899.4
D447,149 S * 8/2001 Davis et al. ..... D15/9

* cited by examiner

*Primary Examiner*—A. Michael Chambers
(74) *Attorney, Agent, or Firm*—Suiter & Associates PC

(57) ABSTRACT

The present invention is directed to an air compressor assembly including a lifting handle. An air compressor assembly suitable for lifting includes an air reservoir suitable for storing compressed air under pressure, the reservoir having a front-end portion, a rearward portion, a first side portion, and a second side portion. A lift handle assembly suitable for use in lifting the air compressor assembly is at least partially disposed on at least one of the first and second side portions. In an additional aspect of the present invention, an air compressor assembly suitable for lifting includes an air reservoir suitable for storing compressed air having a first end portion and a second end portion. A wheel assembly suitable for transporting the air compressor assembly is disposed on the second end portion of the air reservoir. A transport handle assembly suitable for use in controlling transportation of the air compressor assembly when utilizing the wheel assembly is disposed on the first end portion of the air reservoir. A lifting handle assembly suitable for use in lifting the air compressor assembly is at least at least partially disposed on the second end portion of the air reservoir.

21 Claims, 12 Drawing Sheets

AIR COMPRESSOR ASSEMBLY INCLUDING A LIFTING HANDLE

CROSS REFERENCE TO RELATED APPLICATION

The present invention claims benefit of 35 U.S.C. §119(e) of U.S. Application No. 60/187,680 filed Mar. 8, 2000. Said U.S. Patent Application 60/187,680 is herein incorporated by reference in its entirety.

FIELD OF THE INVENTION

The present invention generally relates to the field of air compressor assemblies, and particularly to an air compressor assembly including a lifting handle.

BACKGROUND OF THE INVENTION

The supply of compressed air is one of the most important considerations in manufacturing operations. From residential construction to plant operations, compressed air is utilized to perform many necessary operations, such as powering air tools and sprayers. In portable applications, air compressor assemblies are typically transported with the use of a wheel assembly and a transport handle assembly used to guide the air compressor assembly when utilizing the wheel assembly. However, a typical transport handle assembly is not suited for lifting the air compressor, such as when the air compressor assembly is loaded into a truck, needs to be transported over stairs, lifted over uneven ground, and the like. For example, a typical transport handle may be positioned at one end of the air compressor assembly, thereby providing support to only one end of the air compressor assembly. Further, an air compressor assembly may weigh hundreds of pounds, thereby requiring a substantial force to be exerted to lift the air compressor assembly.

The failure of the typical transport handle assembly to supply an accommodating way of lifting the air compressor assembly often requires users, when trying to lift the air compressor assembly to wrap their arms around the air reservoir, grasp a wheel assembly, grip the motor assembly, and engage in other very difficult and unsure maneuvers. These maneuvers may cause damage to the air compressor assembly and even injury to the user due to the size and weight of a typical air compressor assembly.

Therefore, it would be desirable to provide an air compressor assembly including a lifting handle.

SUMMARY OF THE INVENTION

Accordingly, the present invention is directed to an air compressor assembly including a lifting handle. In a first aspect of the present invention, an air compressor assembly suitable for lifting includes an air storage tank suitable for storing compressed air and a wheel assembly suitable for transporting the air compressor assembly disposed on the air storage tank. A lifting handle assembly suitable for use in lifting the air compressor assembly is integrally formed with the wheel assembly.

In a second aspect of the present invention, an air compressor assembly suitable for lifting includes an air reservoir suitable for storing compressed air, the reservoir having a front-end portion, a rearward portion, a first side portion, and a second side portion. A lift handle assembly suitable for use in lifting the air compressor assembly is at least partially disposed on at least one of the first and second side portions.

In a third aspect of the present invention, an air compressor assembly suitable for lifting includes an air reservoir suitable for storing compressed air having a first end portion and a second end portion. A wheel assembly suitable for transporting the air compressor assembly is disposed on the second end portion of the air reservoir. A transport handle assembly suitable for use in controlling transportation of the air compressor assembly when utilizing the wheel assembly is disposed on the first end portion of the air reservoir. A lifting handle assembly suitable for use in lifting the air compressor assembly is at least at least partially disposed on the second end portion of the air reservoir.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 13, exemplary embodiments of the present invention are shown. Air compressor assemblies may include an air reservoir for the storage of compressed air. In portable applications, air compressor assemblies are typically transported with the use of a wheel assembly and a transport handle assembly used to guide the air compressor assembly when utilizing the wheel assembly. However, a typical transport handle assembly is not suited for lifting the air compressor, such as when the air compressor assembly is loaded into a truck, needs to be transported over stairs, lifted over uneven ground, and the like. Therefore, by supplying lifting handles as a part of the air compressor assembly, the assembly may be more easily lifted.

Figure 1:
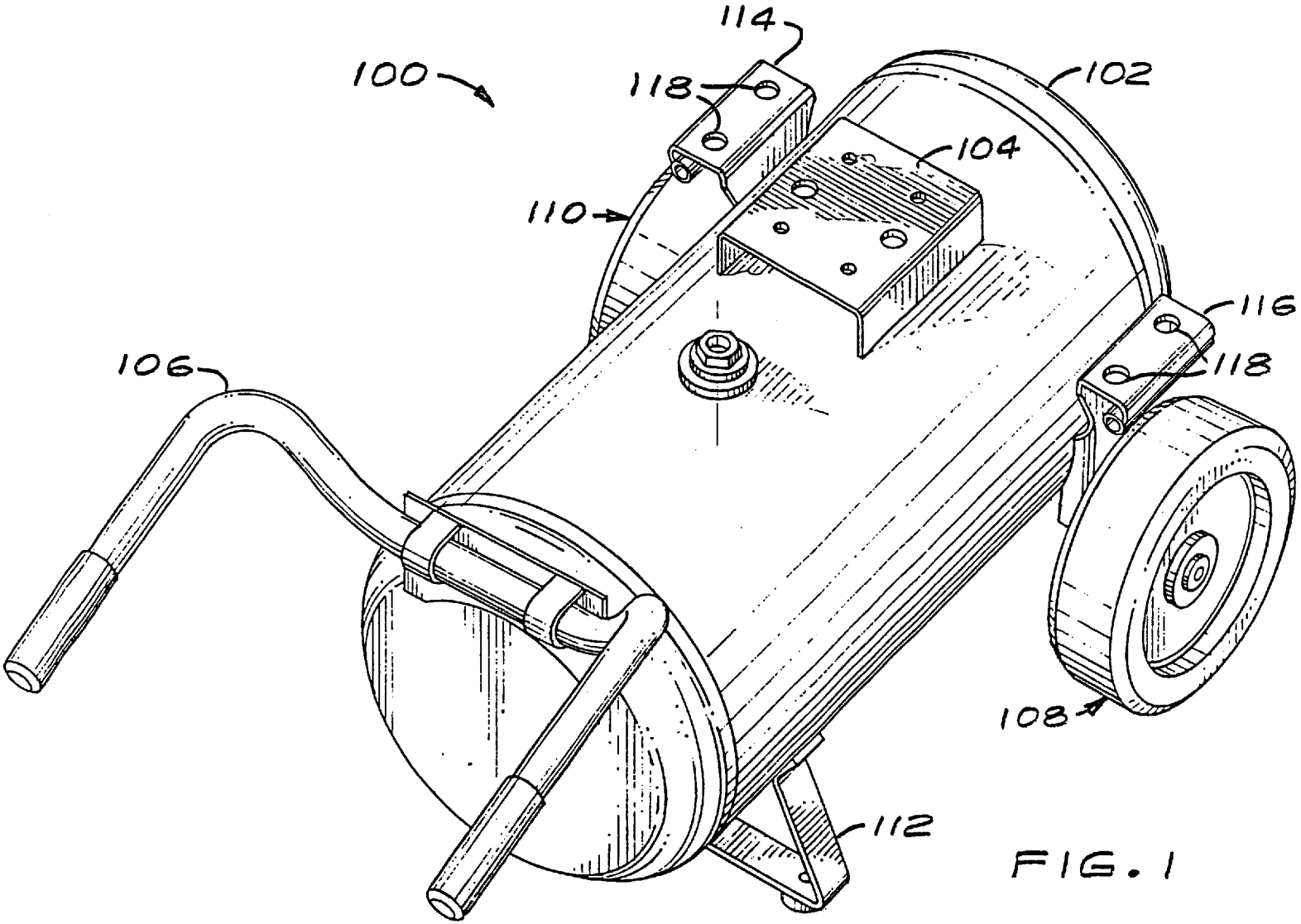
FIG. 1 is an isometric drawing of an exemplary embodiment of the present invention wherein an air compressor assembly includes lifting handles.

Referring now to FIG. 1, an exemplary embodiment of the present invention is shown wherein an air compressor assembly 100 includes lifting handles so as to enable the air compressor to be lifted in an easier manner. The air compressor assembly 100 generally includes an air reservoir 102 for the storage of compressed air. Typically, the supply of compressed air is accomplished through the use of a compressor and motor, which may be gasoline, electric, and the like which may be mounted to the air reservoir 102 with the use of an engine mount 104. A transport handle 106 may be utilized to control the movement of the air compressor assembly 100 when utilizing the wheel assemblies 108 and 110. In this way, the air compressor assembly 100 is capable of portable operation by tilting the base 112 from the ground thereby permitting the wheel assemblies 108 and 110 to proceed. However, the use of transport handles 106 alone is not well suited for lifting the air compressor assembly 100. Therefore, a lifting handle 112 and 114 is positioned on each side of the air reservoir 102 proximally to the wheel assemblies 108 and 110 to enable the air compressor assembly 100 to be lifted without the necessity of the unsure grasping and wrestling of an air compressor assembly as previously required.

It may also be preferable to include tie-down points 118 with the lifting handles 114 and 116 to secure the air compressor assembly 100 during transport. For example, an air compressor assembly 100 is typically not well suited for transport in the back of a truck. During transport, the air compressor assembly 100 may be subjected to jostling and bumps which may cause the air compressor assembly to move in unwanted and unpredictable ways, such as tipping, sliding, and the like. Thus, by providing tie-down points 118, the air compressor assembly 100 may be secured, thereby preventing damage not only to the air compressor assembly 100, but also its surroundings.

Figure 2:
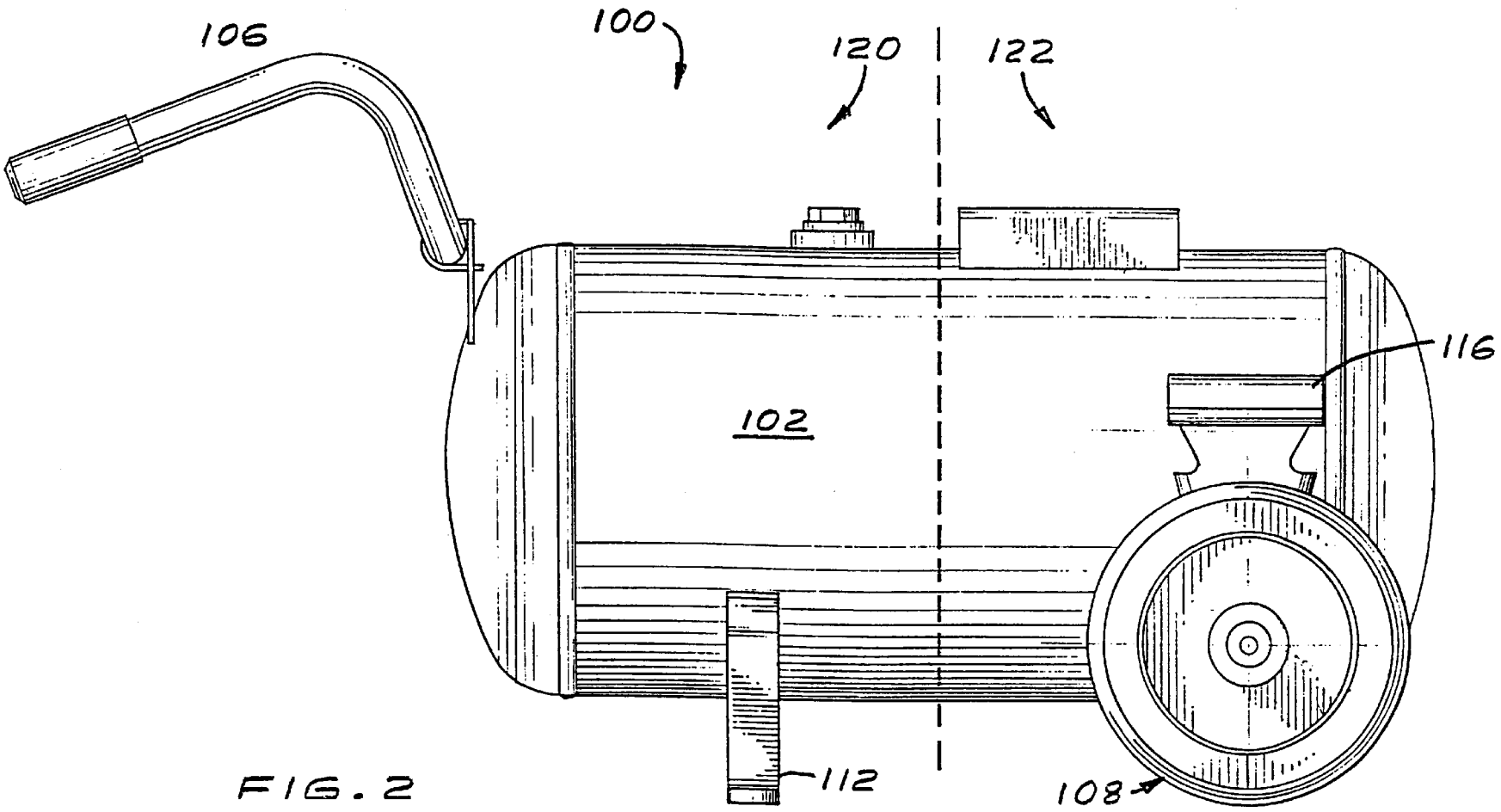
FIG. 2 is a side view of the exemplary embodiment illustrated in FIG. 1, wherein a lifting handle is formed as an integral part of a wheel assembly.

Referring now to FIG. 2, a side view of the exemplary embodiment of FIG. 1 is shown. An air compressor assembly 100 includes an air reservoir 102. The air reservoir 102 includes a transport handle 106 and wheel assembly 108 for rolling the air compressor assembly 100. The air reservoir 102 may be defined to include a first end portion 120 and a second end portion 122. Accordingly, in the present example, the first end portion 120 may include the wheel assembly 108 and the lifting handle 116, and the second end portion 122 may include the transport handle 106. In this way, both the first end portion 120 and the second end portion 122 are supported when the air compressor assembly 100 is lifted. Thus, the breakage and effort previously associated with lifting an air compressor assembly may be greatly diminished.

Figure 3:
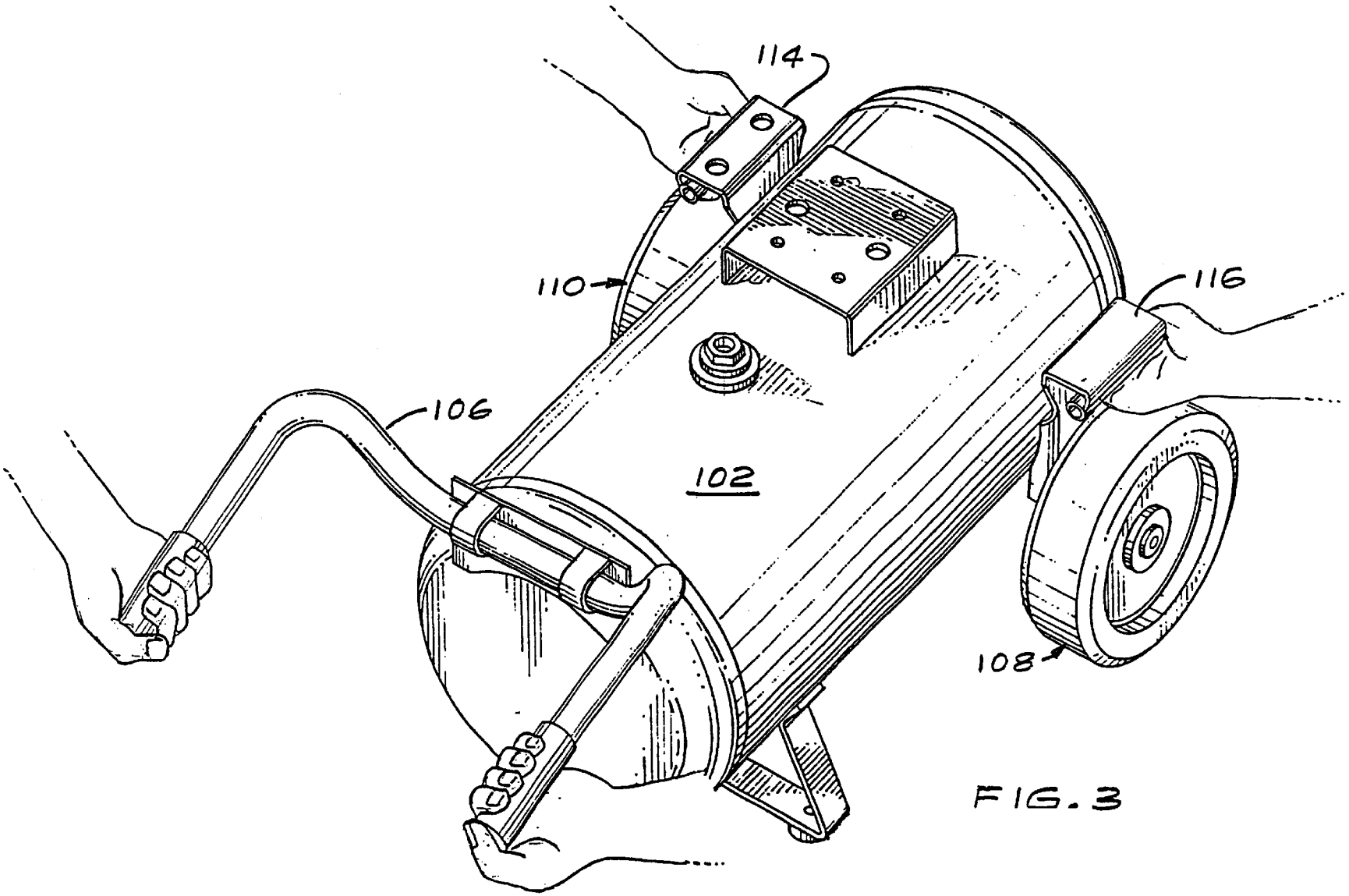
FIG. 3 is an additional side view of the exemplary embodiment illustrated in FIG. 1, wherein a lifting handle is employed to lift the air compressor assembly.

As shown in FIG. 3, lifting handles 114 and 116 positioned on an air reservoir 102 enable users to lift the air compressor assembly 100 in an efficient manner. In this example, a user grasps the first lifting handle 114 and the transport handle from one side while another user grasps the second lifting handle 116 and the transport handle 106 to be able to lift the air compressor assembly 100 in a secure manner. In another example, a user may be positioned on the end of the air compressor assembly to grasp both lifting handles 114 and 116 while another user grasps the transport handle 106 to lift the air compressor assembly 100 from the ends.

Figure 4:
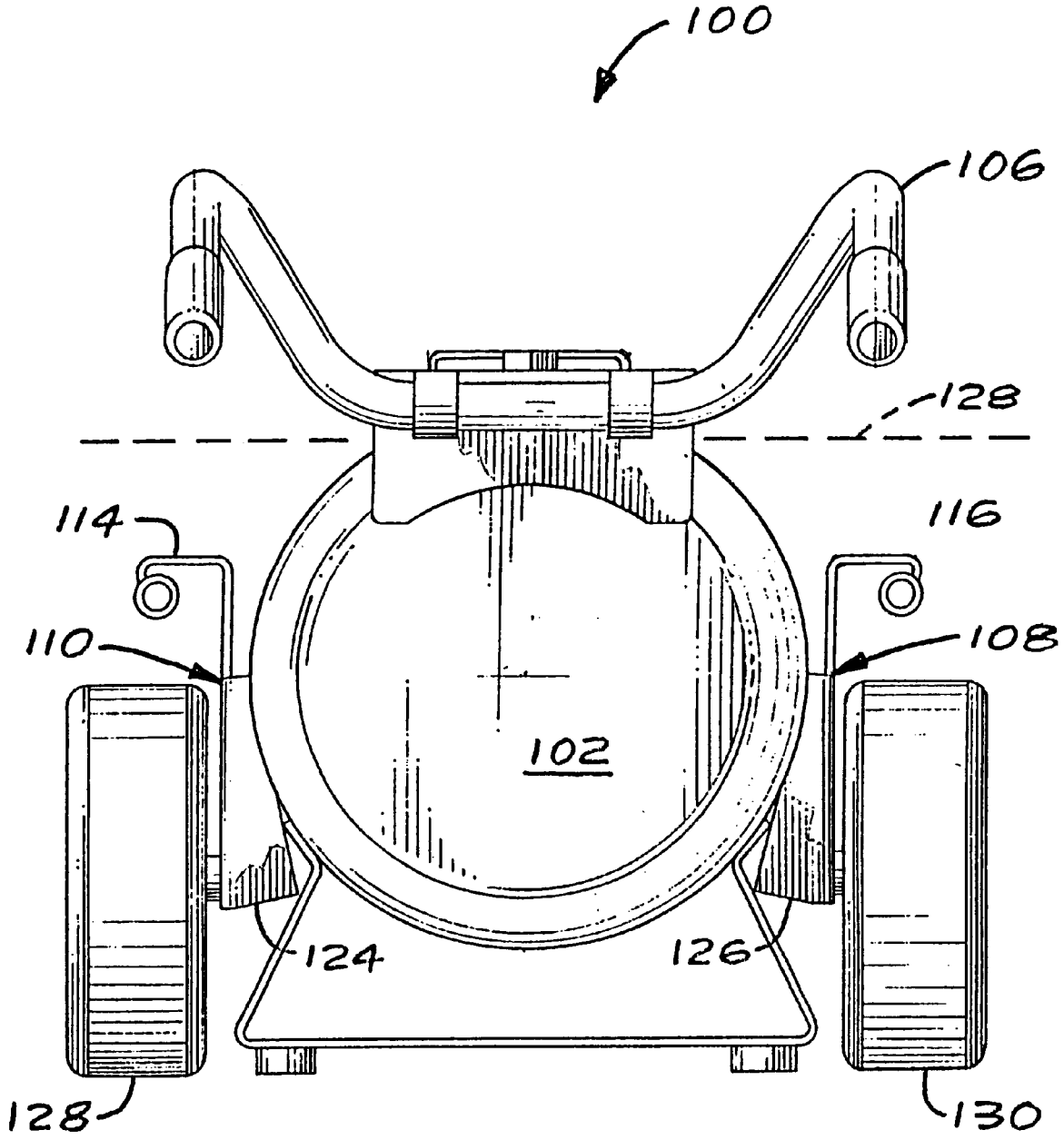
FIG. 4 is an end view of an additional exemplary embodiment wherein an integrated lifting handle and wheel assembly is shown.

Referring now to FIG. 4, an end view of the exemplary embodiment of FIG. 1 is shown. It may be preferable to include the lifting handles 114 and 116 as an integral part of the wheel assemblies 108 and 110 to provide an integrated part that may be manufactured and attached in a cost-effective manner. The wheel assemblies 108 and 110 may include wheel mounts 124 and 126 suitable for attaching wheels 128 and 130, thereby enabling the air compressor assembly 100 to be rolled. In this example, the wheel assemblies 108 and 110 are shown as two separate wheel assemblies 108 and 110, which may be preferable so as to reduce the cost of materials. However, a single wheel assembly may also be utilized which includes two wheels, a single wheel, a plurality of wheels and brackets, and the like without departing from the spirit and scope of the present invention.

It may also be preferable to locate the lift handles 114 and 116 below or generally equal to the top edge 128 of the air reservoir 102. By locating the lifting handles 114 and 116 below the top edge of the air reservoir 128, a user may be better able to control the lifting of the air compressor assembly 100 as well as have an increased lifting range. For example, a user, grasping a transport handle 106 may not be able to lift the air compressor assembly 100 as high as with a lower located lifting handle 114 and 116, which may be required when loading the air compressor assembly in the back of a truck, carrying the air compressor assembly over rough terrain, and the like. Thus, the location of the lifting handles 114 and 116 below the top edge of the air reservoir 102 may enable the air compressor assembly 100 to be lifted in an improved manner.

Figure 5:
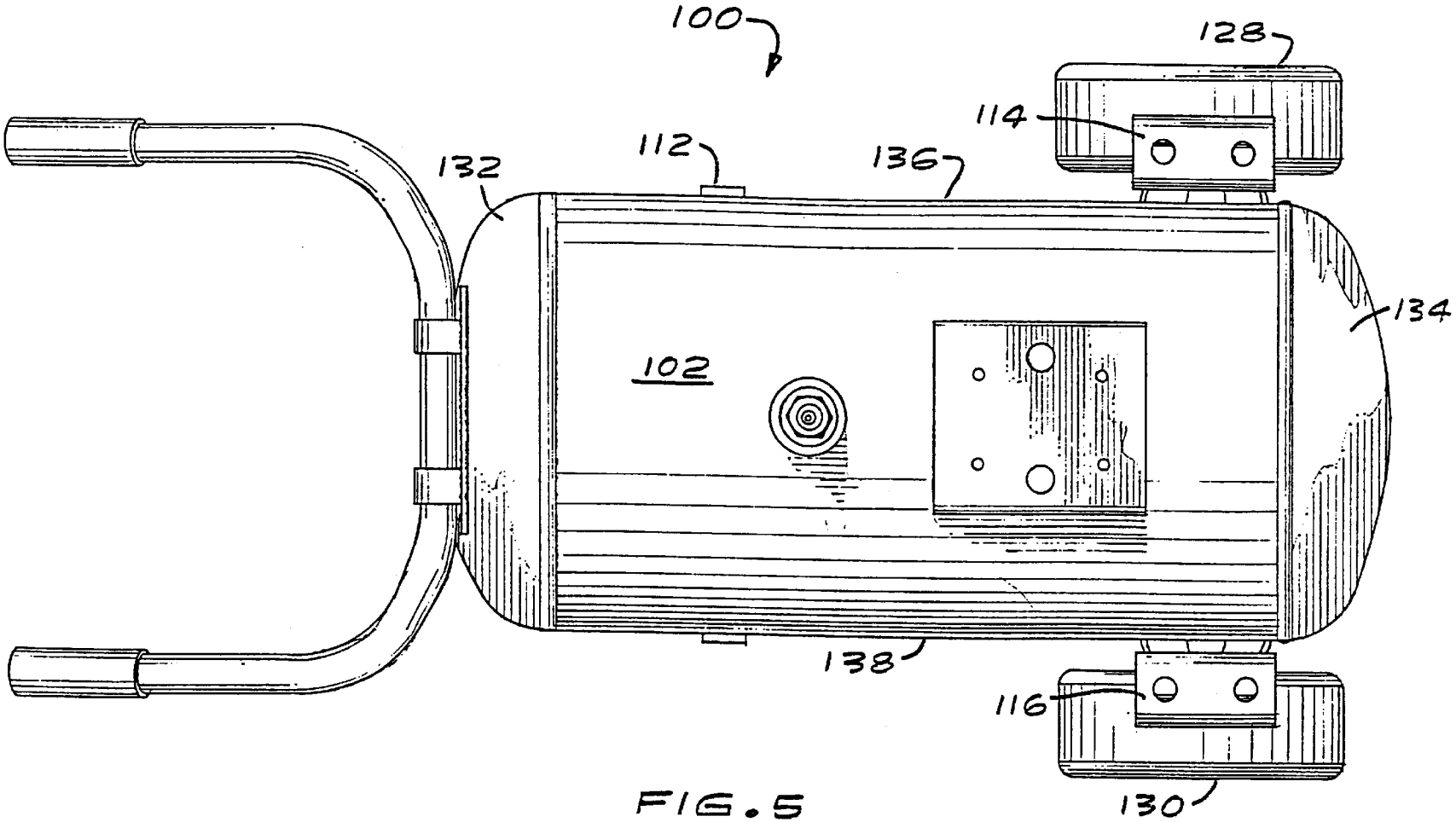
FIG. 5 is a top view of the exemplary embodiment illustrated in FIG. 1 indicating the position of the lifting handle.

Referring now to FIG. 5, a top view of the exemplary embodiment of FIG. 1 is shown. An air compressor assembly 100 suitable for storing compressed air includes an air reservoir 102. The air reservoir 102 includes a front-end portion 132, a rearward portion 134, a first side portion 136, and a second side portion 138. Lift handle assemblies 114 and 116, suitable for use in lifting the air compressor assembly 100, are at least partially disposed on at least one of the first 136 and second 138 side portions. In this way, users positioned at both sides 136 and 138 may be able to lift the air compressor assembly 100, as shown in FIG. 3. This may prove especially useful when trying to lift the air compressor assembly 100 onto a higher surface. For example, users may lift the air compressor assembly 100 from the side 136 and 138, position the wheels 128 and 130 on the surface, and then roll the air compressor assembly 100 so that the base 112 is also placed on the surface. Thus, lifting the air compressor assembly 100 is much easier than the wrestling that was required to lift previous air compressor assemblies.

Figure 6:
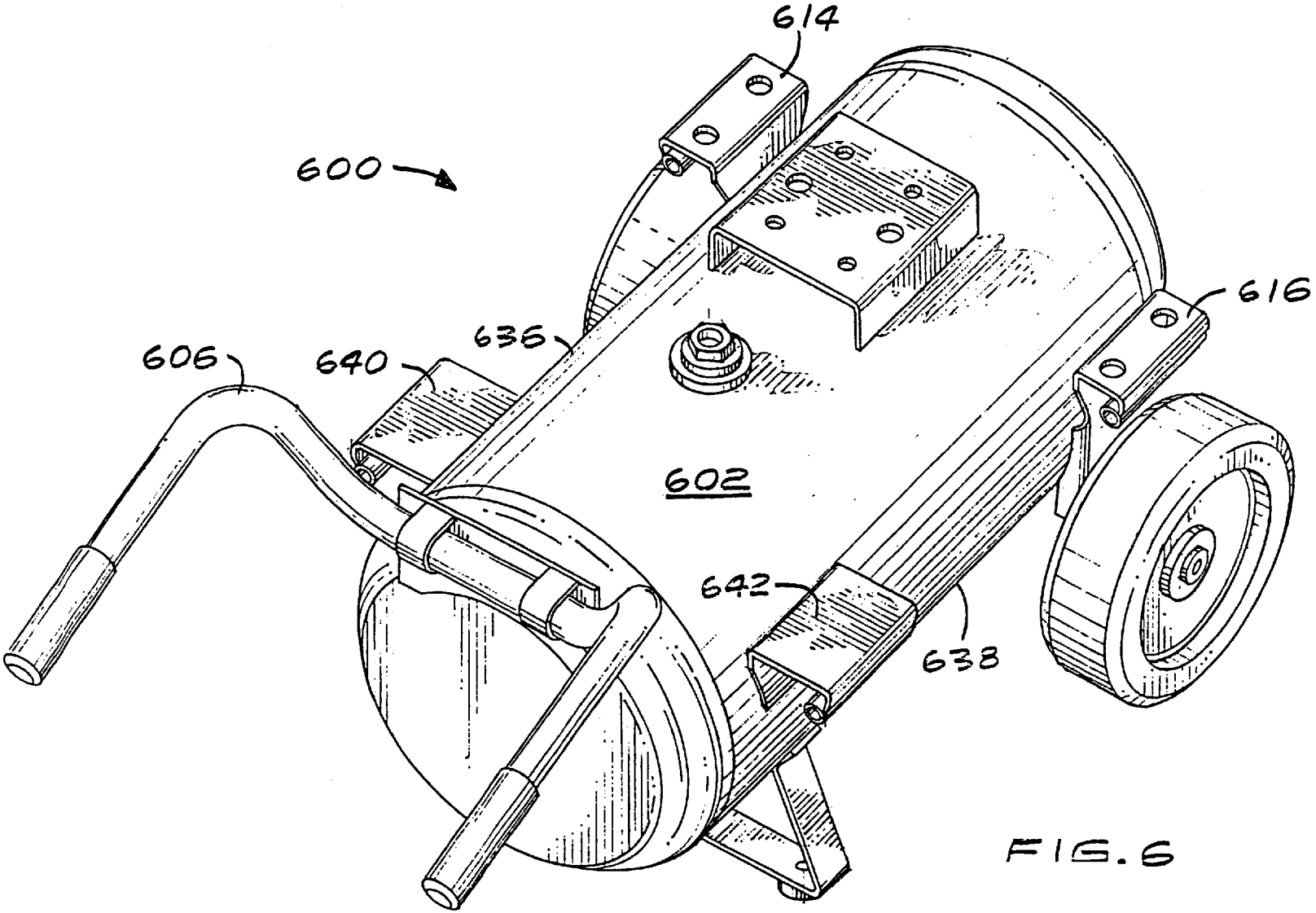
FIG. 6 illustrates an additional exemplary embodiment of the present invention wherein additional lifting handle placement is shown.

Lifting handles may take many different forms and be placed at a variety of positions without departing from the spirit and scope of the present invention. For example, as shown in FIG. 6 in an additional exemplary embodiment of the present invention, a plurality of lifting handles may be placed on the side of an air compressor assembly 600. In this example, a second lifting handle 642 and 640 is added to each side 636 and 638 of the air compressor assembly 600. Thus, each side of the air reservoir 602 includes a first lifting handle 616 and 614 and a second lifting handle 640 and 642 to enable a user positioned at a side 636 and 638 of the air compressor assembly 600 to lift the assembly 600 without having to reach for the transport handle 606. This may further enable a user to lift the air assembly in an efficient manner, without causing damage to the air compressor assembly 600 or injury to the user. For example, the weight and size of an air compressor assembly 600 may be quite substantial. By enabling a user to lift the air compressor assembly 600 in a more natural manner, the chances of injury due to over-reaching and the damage that may be caused to the assembly if dropped may be greatly reduced.

Figure 7:
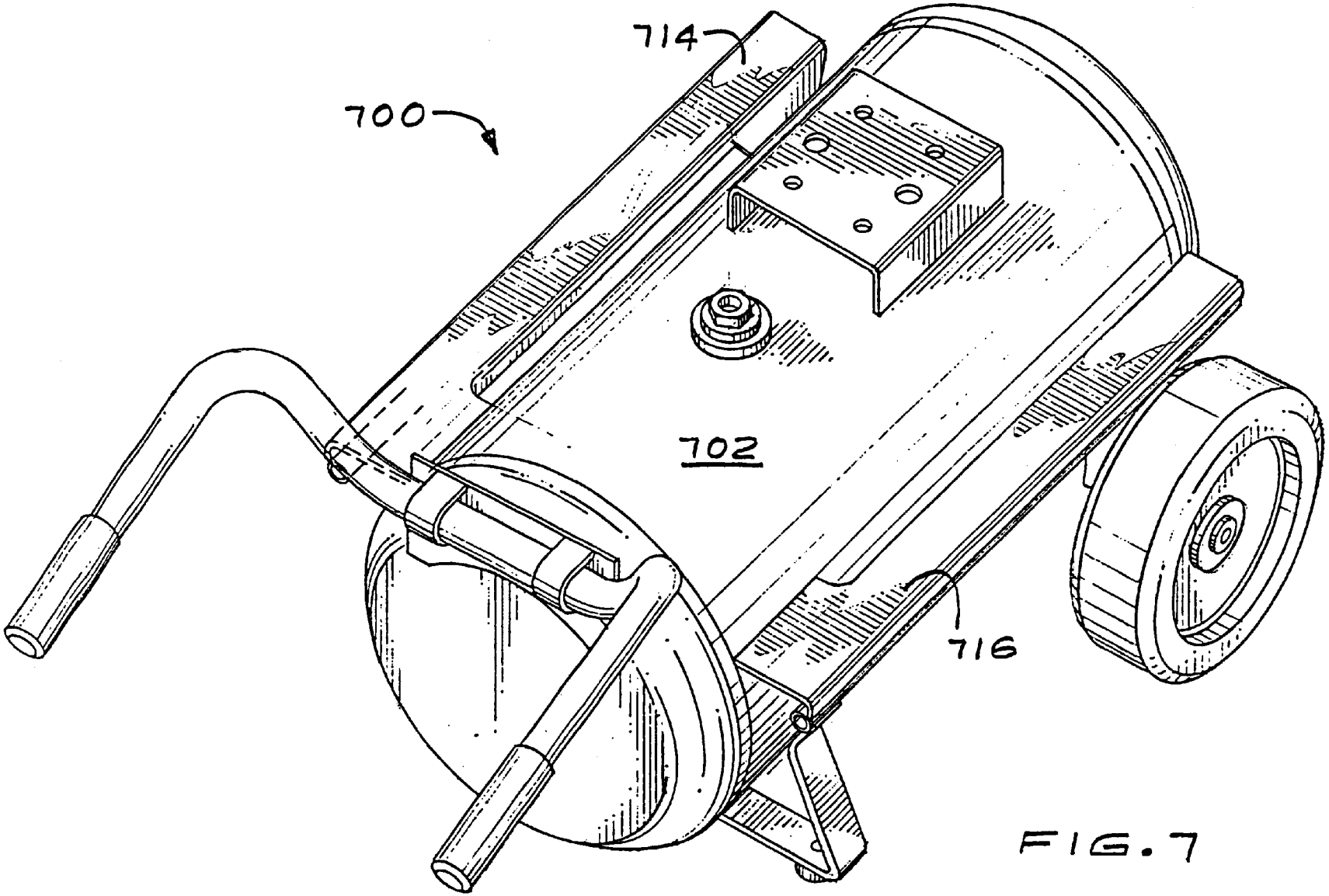
FIG. 7 depicts an additional exemplary embodiment of the present invention wherein a lifting handle is shown extending substantially along the length of an air reservoir.

Additionally, the lifting handles may extend along the sides of the air compressor assembly, an example of which is shown in FIG. 7. A first lifting handle 714 and a second lifting handle 716 extend generally along the side of the air compressor assembly 700. These handles 714 and 716 may be attached to the air reservoir 702 and extend generally along the middle section of the air reservoir to provide an extended gripping region. Thus, multiple users may utilize the lifting handles 714 and 716 to lift the air compressor assembly 700, which may further prevent injury and damage.

Figure 8:
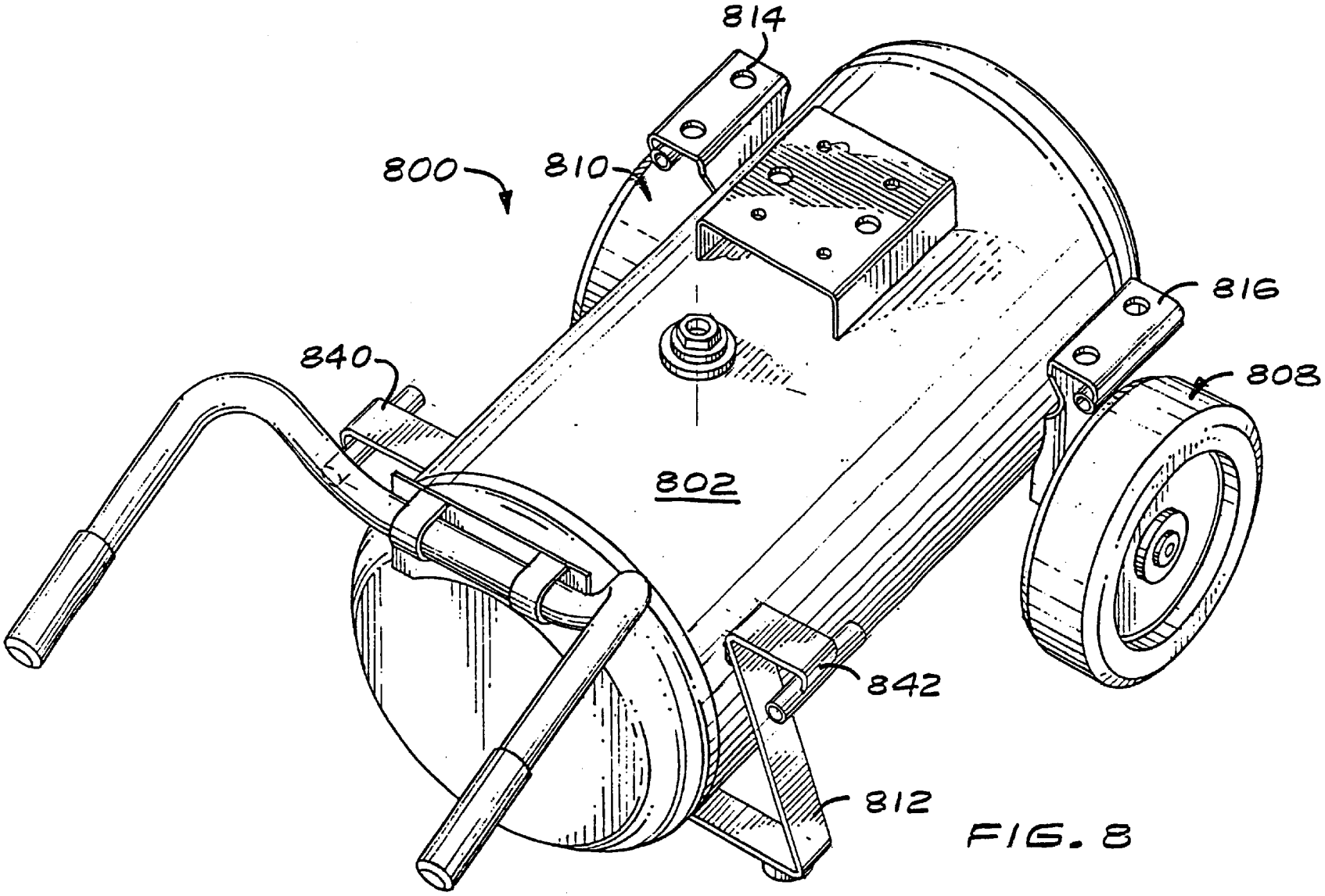
FIG. 8 illustrates an additional exemplary embodiment of the present invention wherein a lifting handle is shown formed as an integral part of an air reservoir support assembly.

Furthermore, the lifting handles may be formed as an integral part of the base of the air compressor assembly. For example, as shown in FIG. 8, an air compressor assembly 800 may incorporate a wheel assembly 808 and 810 with integral lifting handles 814 and 816. A base 812 of the air compressor assembly may also incorporate lifting handles 840 and 842 to provide an additional gripping region. In this way, the handles 840 and 842 may be manufactured with the base 812, resulting in a cost saving in both production and assembly. Further the additional set of handles 840 and 842 provide increased control and ease of use as described in FIG. 6.

Figure 9:
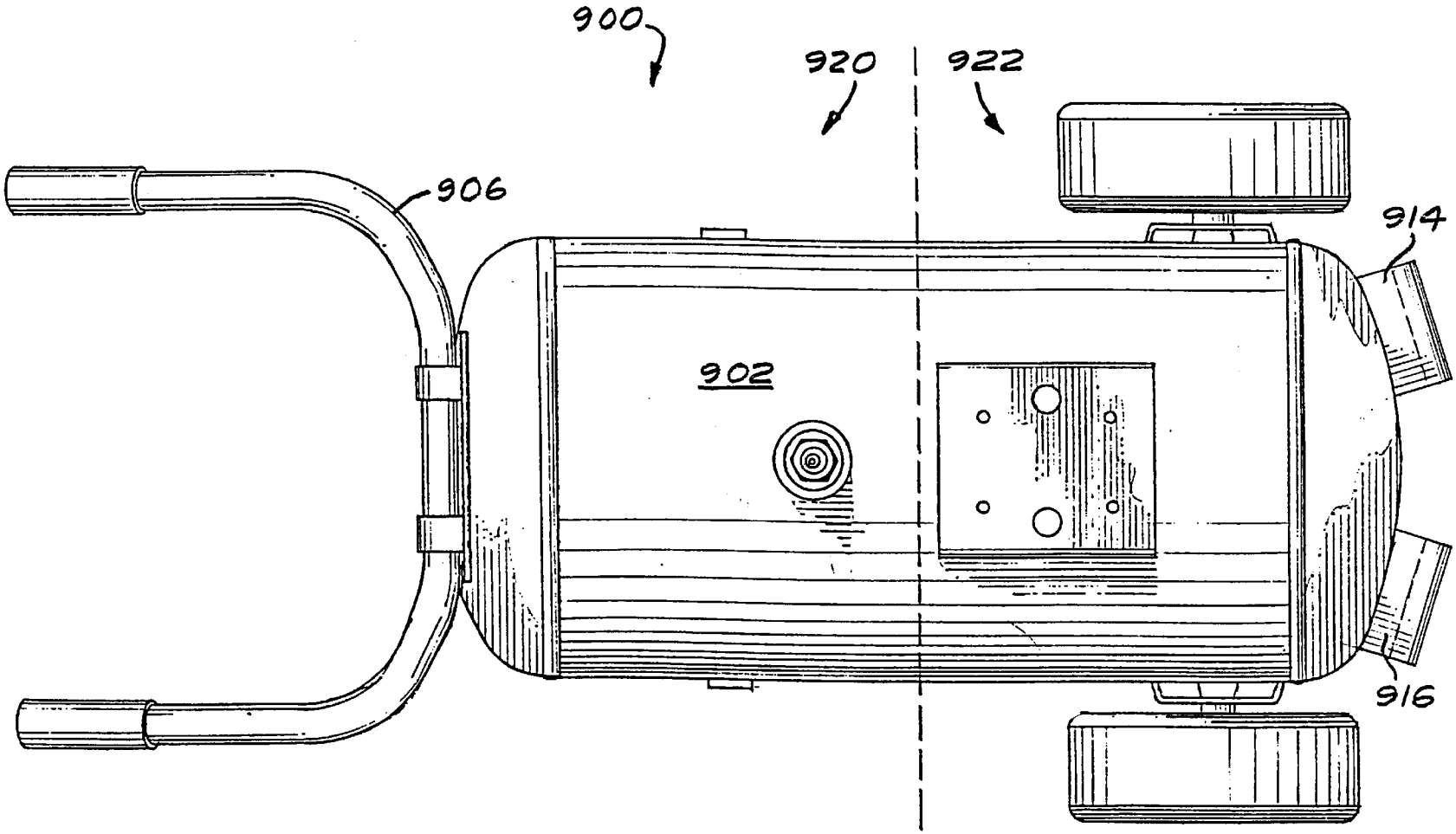
FIG. 9 illustrates an additional exemplary embodiment wherein a lifting handle position on the rearward portion of an air reservoir is shown.

Lifting handles may also be positioned at the end of the air compressor assembly, an example of which is shown in FIG. 9. The air reservoir 902 may include a first end portion 920 and a second end portion 922. The first end portion 920 may include the transport handle 906 and the second end portion 922 may include the wheel assembly 908 and a first lifting handle 914 and a second lifting handle 916. Thus, both the first end portion 920 and the second end portion 922 are supported when the air compressor assembly 900 is lifted.

Figure 10:
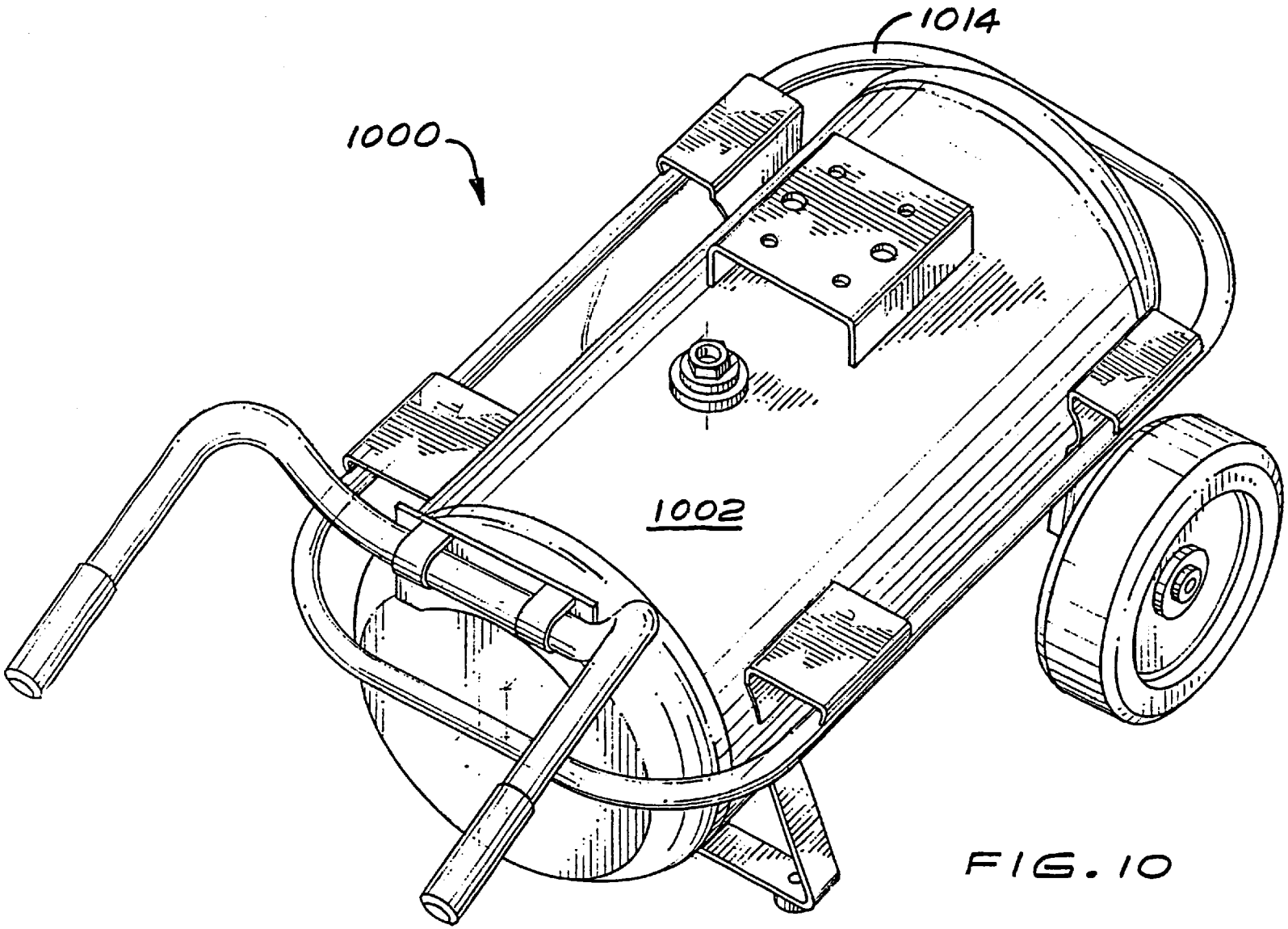
FIG. 10 depicts an additional exemplary embodiment wherein a lifting handle is shown extending substantially around an air reservoir in a horizontal manner.

Lifting handles may also be formed so as to surround the air reservoir. For example, as shown in FIG. 10, an air compressor assembly 1000 may include an air reservoir 1002 with a lifting handle 1014 extending substantially around the air reservoir 1002 in a horizontal manner. In this example, the lifting handle 1014 extend through both the first end portion 920 and the second end portion 922 as discussed in FIG. 9. The air reservoir 1002 formed in a cylindrical shape, is positioned horizontally, i.e. the longest dimension of the air reservoir 1002 is horizontal. The lifting handle 1014, also positioned in a horizontal manner, may provide a variety of grasping regions to enable a user to lift the air compressor assembly 1000. Additionally, the lifting handle 1014 may provide protection to the air compressor assembly 1000 from damage as well as supply multiple tie-down points, as discussed in FIG. 1, to secure the air compressor assembly 1000.

Figure 11:
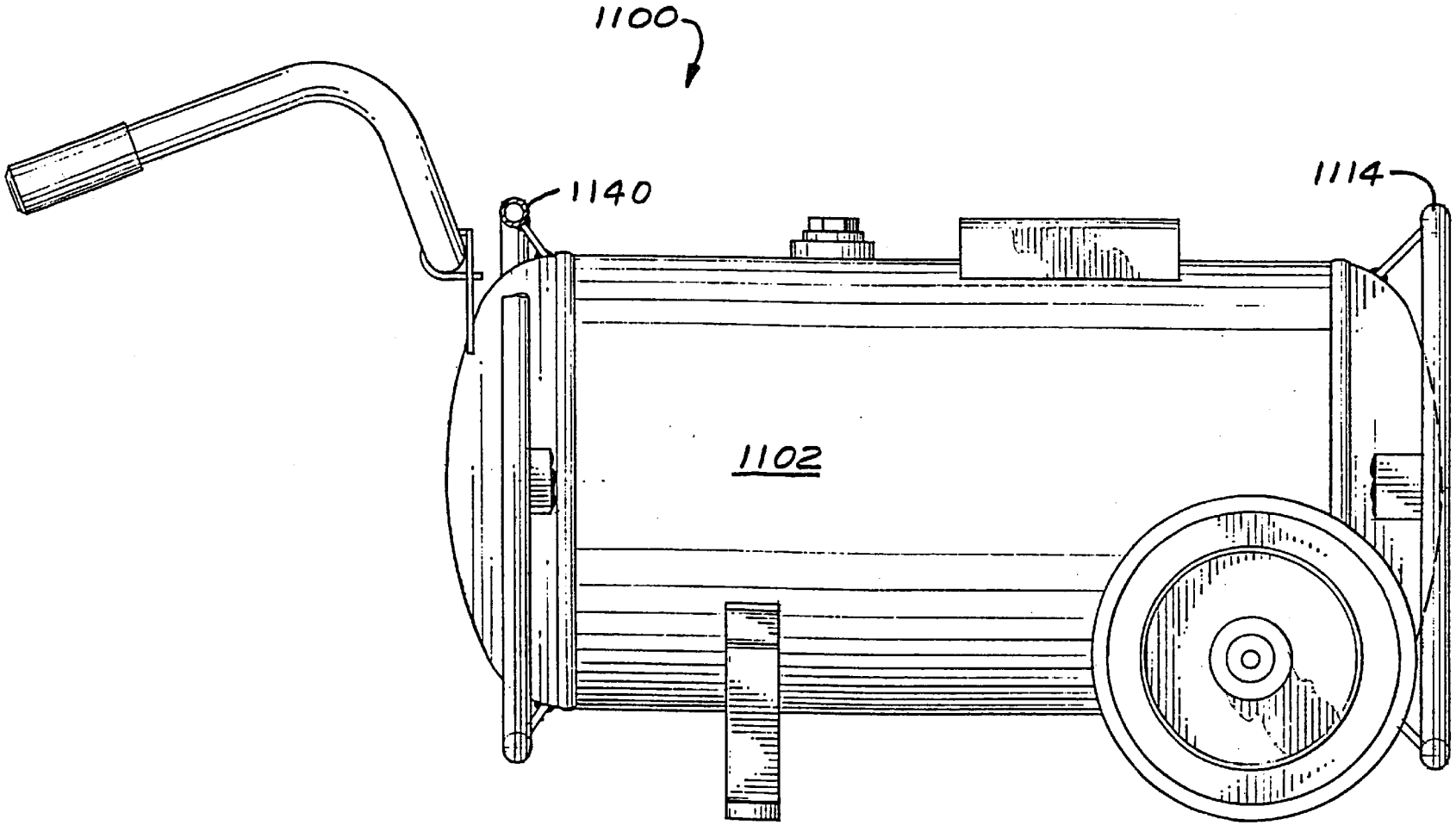
FIG. 11 illustrates an additional exemplary embodiment wherein lifting handles are shown extending substantially around an air reservoir in a vertical manner.

The lifting handles may also be formed so as to surround the air reservoir in a vertical manner, an example of which is shown in FIG. 11. An air compressor assembly 1100 includes an air reservoir 1102 positioned in a horizontal manner. Lifting handles 1114 and 1140 extend substantially around the air reservoir 1102 in a vertical manner. In this way, a plurality of grasping regions may be provided with the added benefit of protecting the air compressor assembly 1100.

Figure 12:
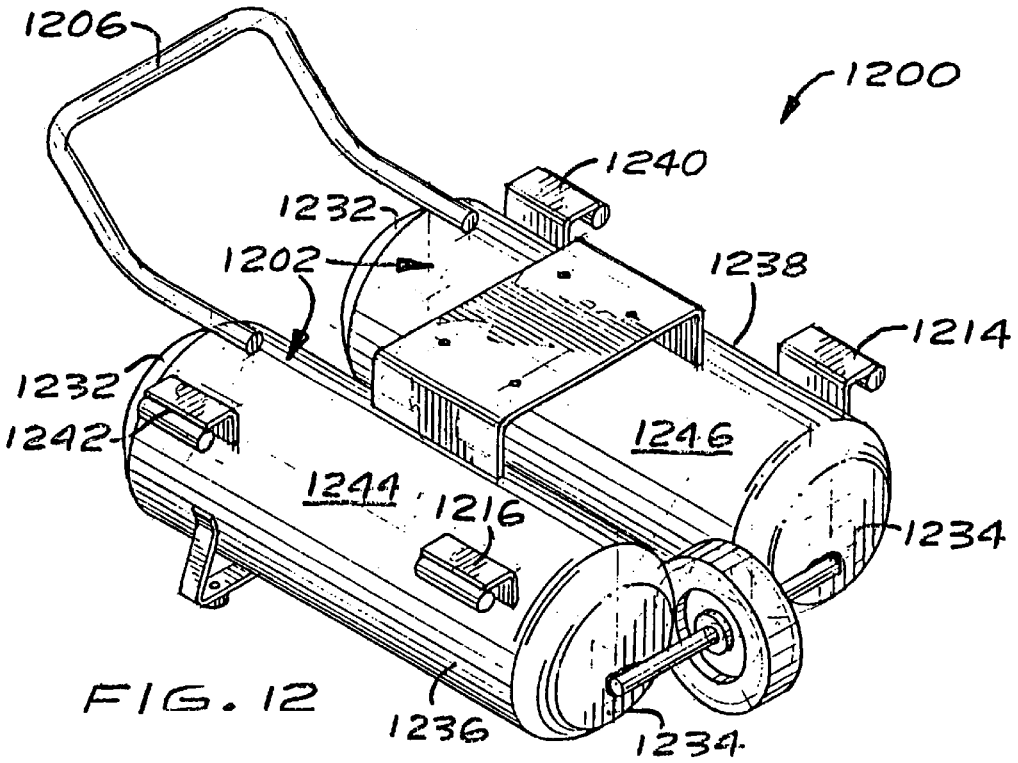
FIG. 12 depicts an additional exemplary embodiment wherein a lifting handle is shown positioned on an air reservoir including two air storage tanks.

An air reservoir may take a variety of shapes and positions without departing from the spirit and scope of the present invention. For example, as shown in FIG. 12, an air compressor assembly 1200 includes an air reservoir 1202 having a first air storage tank 1244 and a second air storage tank 1246 formed in generally cylindrical shapes. The air reservoir 1202 includes a front-end portion 1232, a rearward portion 1234, a first side portion 1236, and a second side portion 1238. Lift handle assemblies 1214 and 1216, suitable for use in lifting the air compressor assembly 1200, are at least partially disposed on at least one of the first 1236 and second 1238 side portions. A second lifting handle 1242 and 1240 is added to each side 1236 and 1238 of the air compressor assembly 1200. In this way, each side of the air reservoir 1202 includes a first lifting handle 1216 and 1214 and a second lifting handle 1240 and 1242 to enable users positioned at the sides 1236 and 1238 of the air compressor assembly 1200 to lift the assembly 1200 without having to reach for the transport handle 1206.

Figure 13:
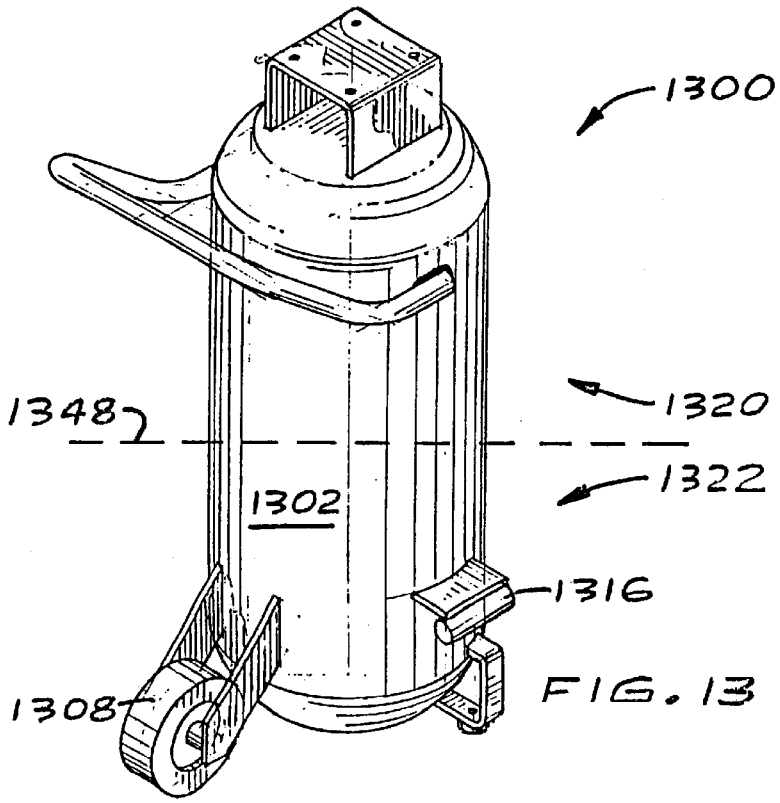
FIG. 13 depicts an additional exemplary embodiment of the present invention wherein a lifting handle is shown positioned on an air reservoir formed as a vertical air storage tank.

The air compressor assembly may also include an air reservoir oriented in a vertical direction, an example of which is shown in FIG. 13. An air compressor assembly 1300 includes an air reservoir 1302 oriented in a vertical manner, i.e. the longest dimension of the air reservoir is positioned generally vertical. The air reservoir 1302 may be described so that the longest dimension of the air reservoir 1302 includes a first end portion 1320 and a second end portion 1322. The first end portion 1320 and the second end portion 1322 may be divided generally at a midpoint 1348 along a length of the longest dimension of the air reservoir 1302. Thus, the second end portion 1322 may include the wheel assembly 1308 and the lifting handle 1316, and the first end portion 1320 may include the transport handle 1306 to enable improved lifting of the air compressor assembly 1300.

It is believed that the air compressor assembly including a lifting handle of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An air compressor assembly suitable for lifting, comprising:

an air reservoir suitable for storing compressed air, wherein the air reservoir includes a first portion and a second portion;

a wheel assembly suitable for transporting the air compressor assembly, the wheel assembly disposed on the air reservoir;

a transport handle assembly suitable for use in controlling transportation of the air compressor assembly when utilizing the wheel assembly, the transport handle disposed on the first portion of the air reservoir; and a lifting handle assembly suitable for use in lifting the air compressor assembly wherein the lifting handling assembly is integrally formed with the wheel assembly, the wheel assembly and the lifting handle assembly disposed on the second portion of the air reservoir.

2. The air compressor assembly as described in claim 1, wherein the lifting handle assembly does not extend above a top edge of the air reservoir.

3. The air compressor assembly as described in claim 1, further comprising a second lifting handle assembly.

4. The air compressor assembly as described in claim 3, wherein the first lifting handle assembly and the second lifting handle assembly are disposed on opposing sides of the air reservoir so as to be suitable for lifting the air compressor assembly by users positioned at the opposing sides of the air reservoir.

5. The air compressor assembly as described in claim 1, wherein the air reservoir includes at least one of an air storage tank formed in a generally cylindrical shape and a first air storage tank and a second air storage tank formed in generally cylindrical shapes.

6. The air compressor assembly as described in claim 5, wherein the air reservoir is oriented in at least one of a generally horizontal and generally vertical direction.

7. The air compressor assembly as described in claim 1, wherein the air reservoir includes a front-end portion, a rearward portion, a first side portion, and a second side portion; and the lift handle assembly is at least partially disposed on at least one of the first and second side portions.

8. An air compressor assembly suitable for lifting, comprising:

an air reservoir suitable for storing compressed air under pressure, the reservoir having a front-end portion, a rearward portion, a first side portion, and a second side portion;

a transport handle assembly suitable for use in controlling transportation of the air compressor assembly when utilizing a wheel assembly, the transport handle disposed on the front-end portion of the air reservoir and the wheel assembly disposed on the rearward portion of the air reservoir;

a first lift handle suitable for use in lifting the air compressor assembly, the first lift handle at least partially disposed on the first side portion of the air reservoir; and a second lift handle suitable for use in lifting the air compressor assembly, the second lift hand at least partially disposed on the second side portion of the air reservoir.

9. The air compressor assembly as described in claim 8, wherein the lift handle assembly is formed as an integral part of the wheel assembly.

10. The air compressor assembly as described in claim 8, wherein the lifting handle assembly does not extend above a top edge of the air reservoir.

11. The air compressor assembly as described in claim 8, wherein the first lifting handle assembly and the second lifting handle assembly are disposed on opposing sides of the air reservoir so as to be suitable for lifting the air compressor assembly by users positioned at the opposing sides of the air reservoir.

12. The air compressor assembly as described in claim 8, wherein the air reservoir includes at least one of an air storage tank formed in a generally cylindrical shape and a first air storage tank and a second air storage tank formed in generally cylindrical shapes.

13. The air compressor assembly as described in claim 12, wherein the air reservoir is oriented in at least one of a generally horizontal and generally vertical direction.

14. An air compressor assembly suitable for lifting, comprising:

an air reservoir suitable for storing compressed air having a first end portion and a second end portion;

a wheel assembly suitable for transporting the air compressor assembly disposed on the second end portion of the air reservoir;

a transport handle assembly suitable for use in controlling transportation of the air compressor assembly when utilizing the wheel assembly, the transport handle disposed on the first end portion of the air reservoir; and a lifting handle assembly suitable for use in lifting the air compressor assembly, the handle lifting assembly disposed at least partially on the second end portion of the air reservoir.

15. The air compressor assembly as described in claim 14, wherein the lifting handle assembly does not extend above a top edge of the air reservoir.

16. The air compressor assembly as described in claim 14, wherein the lifting handle assembly is integrally formed with the wheel assembly.

17. The air compressor assembly as described in claim 14, further comprising a second lifting handle assembly.

18. The air compressor assembly as described in claim 17, wherein the first lifting handle assembly and the second lifting handle assembly are disposed on opposing sides of the air reservoir so as to be suitable for lifting the air compressor assembly by users positioned at the opposing sides of the air reservoir.

19. The air compressor assembly as described in claim 14, wherein the air reservoir includes at least one of an air storage tank formed in a generally cylindrical shape and a first air storage tank and a second air storage tank formed in generally cylindrical shapes.

20. The air compressor assembly as described in claim 19, wherein the air reservoir is oriented in at least one of a generally horizontal and generally vertical direction.

21. The air compressor assembly as described in claim 14, wherein the air reservoir includes a front portion, a rearward portion, a first side portion, and a second side portion; and the lift handle assembly is at least partially disposed on at least one of the first and second side portions.

* * * * *